US005290129A

United States Patent [19]

Rody et al.

[11] Patent Number: 5,290,129

[45] Date of Patent: Mar. 1, 1994

[54] TRENCH SHIELD ASSEMBLY

[76] Inventors: Kenneth G. Rody, 8616 - 57th Ave. Ct. E.; Richard D. Rody, 11703 - 138th Ave. Ct. E.; Bradley W. Rody, 8701 - 61st St. Ave. E.,, all of Puyallup, Wash. 98371

[21] Appl. No.: 745,316

[22] Filed: Aug. 15, 1991

[51] Int. Cl.[5] ..... E02D 17/00

[52] U.S. Cl. ..... 405/282; 405/272

[58] Field of Search ..... 405/141, 142, 272, 282, 405/283, 284, 285

[56] References Cited

U.S. PATENT DOCUMENTS

| | | | |
|---|---|---|---|
| 3,496,727 | 2/1970 | Weese et al. | 61/41 |
| 3,541,799 | 11/1970 | Jost et al. | 405/283 |
| 3,992,887 | 11/1976 | Fisher | 61/41 |
| 4,058,983 | 11/1977 | Griswold | 405/283 |
| 4,114,383 | 9/1978 | Nieber | 405/282 |
| 4,345,857 | 8/1982 | Krings | 405/282 |
| 4,372,709 | 2/1983 | Krings | 405/282 |
| 4,695,204 | 9/1987 | Bell | 405/283 |

FOREIGN PATENT DOCUMENTS

| | | | |
|---|---|---|---|
| 62-291329 | 12/1987 | Japan | E02D 17/08 |

OTHER PUBLICATIONS

"Go With The Rugged Ones", GME Inc., Union City, Mich., Jul. 27, 1976, pp. 1-14.

"GME Catalog No. 220-A", GME Inc., Union City, Mich., 1989, pp. 2-11.

"Steel Sewer Shoring", Tenafly Welding and Steel, Co., Ltd., Tenafly, N.J., May 11, 1967.

"Efficiency Production, Inc. Catalog", Efficiency Production, Inc., Lansing, Mich., 1991, pp. 2-19.

*Primary Examiner*—David H. Corbin

*Attorney, Agent, or Firm*—Christensen, O'Connor, Johnson & Kindness

[57] ABSTRACT

A trench shield assembly (12) having first and second shield walls (14, 16) maintained spaced apart by a plurality of spacer struts (30) at the front end of the shield walls and an archway (32) secured at the rear end of the shield walls. Each shield wall is constructed from a plurality of beams (18) that are stacked on top of each other and secured together. Each beam includes a central web (20) and first and second face flanges (22, 24). When stacked and secured, the first face flanges define a first exterior skin (26) of the shield wall and the second face flanges define a second exterior skin (28) of the shield wall. The ends of the spacer struts project through transverse passages (44) defined in the shield walls. Stops (46) formed on the spacer struts, at a location spaced from the ends of the struts, limit the degree of insertion of the struts into the transverse passages. A locking plate (50) is secured to each projecting end of the struts to prevent withdrawal of the struts from the passages.

15 Claims, 8 Drawing Sheets

TRENCH SHIELD ASSEMBLY

FIELD OF THE INVENTION

The present invention relates to portable walls for shoring up excavated earth, and more particularly to trench shield wall assemblies for shoring excavated trenches to protect workers laboring therein.

BACKGROUND OF THE INVENTION

During construction it is often necessary to shore up an excavated earth wall. For example, the laying of pipe within a deep trench typically requires a portable trench shield or trench box to be positioned within the portion of the trench in which a new section of pipe is to be placed. The walls of the trench shield protect the workers from collapsing earth. As each piece of pipe is laid, the trench shield is dragged forwardly within the trench by heavy equipment for placement of the next section of pipe.

It is thus desirable to have a trench shield assembly that is strong, has a high section modulus, and is durable such that it will safely shield workers and withstand handling by heavy equipment.

Various trench shield systems have been developed which include first and second parallel shield walls that are spaced apart by spreader bars. To lighten the weight of the shield walls while providing structural integrity, the shield walls are often of hollow construction.

One such example of a conventional hollow shield wall is disclosed by U.S. Pat. No. 4,345,857 to Krings. An internal frame for the shield wall is constructed from parallel horizontal members that are spaced apart on vertical pipes. An outer skin is then secured to either side of the framework.

Another conventional shield wall is disclosed by U.S. Pat. Nos. 3,992,887 to Fisher. The disclosed shield wall is constructed from a frame having horizontal and vertical members over which metal skins are secured. The inner surfaces of the shield walls carry cylindrical collars that are received within the ends of cylindrical spacer beams, to spread and maintain two opposing shield walls apart from each other.

Yet another conventional hollow shield wall construction is disclosed by U.S. Pat. No. 4,114,383 to Nieber. Metal skins are secured over an inner skeletal framework. The inner surface of the shield walls also include cylindrical collars that are received within the ends of cylindrical spacer beams to spread opposing shield walls apart.

Such conventional hollow shield walls have a drawback in that the outer skins are easily pierced by heavy equipment, allowing the interior framework of the shield wall to fill with soil and water. This substantially adds to the weight of the shield walls, making them difficult to reposition within the trench and to transport to other construction sites. Further, it has been found that the sectional strength of such conventional hollow-skinned shield walls is somewhat less than desirable.

An additional drawback of conventional trench shield systems, such as those disclosed by the Fisher '887 and Nieber '383, is the propensity for heavy equipment to sometimes knock the spacer beam collars off of the inside surfaces of the shield walls. At the least, this necessitates repair of the shield wall; at the worst, it could potentially result in injury.

SUMMARY OF THE INVENTION

The present invention provides a trench shield assembly including first and second shield walls, and a mechanism for maintaining the first and second shield walls spaced apart. Each of the first and second shield walls is constructed from a plurality of stacked elongate beams. Each beam includes a central web and first and second parallel face flanges. The beams are stacked on top of each other and secured together, such that the first face flanges of the stacked beams define a first integral exterior skin of the shield wall, and the second face flanges of the stacked beams define a second integral exterior skin of the shield wall. The central webs of the beams thus span between the first and second exterior skins.

In a further aspect of the present invention, each of the first and second shield walls includes at least one transverse passage extending through the shield wall from the first exterior skin to the second exterior skin. The first and second shield walls are disposed with the first exterior skins opposing each other. The mechanism for maintaining the shield walls spaced apart includes an elongate transverse strut having first and second ends that are constructed to be insertable through the transverse passages of the first and second shield walls. When so inserted, the first and second ends of the transverse strut at least approach, and preferably project beyond, the second exterior skins of the shield walls. First and second limit stops are secured to the strut at a location spaced from the first and second ends, respectively, for limiting the degree of insertion of the strut through the first and second passages. An engaging mechanism engages each of the projecting first and second ends of the inserted strut, to prevent withdrawal of the strut from the passages of the first and second shield walls.

The stacked beam construction of the present invention provides for a very strong shield wall with a high section modulus. The shield walls are highly stable and do not flex any more than a desired nominal degree. The weight of the shield wall is comparable to that of conventional shield walls. The shield wall is not easily punctured. However, if punctured, the central webs of the beams prevent soil and water leakage into more than a small portion of the interior of the shield wall, thus preventing it from becoming overly heavy.

The insertion of the transverse spacer struts through transverse passages formed in the shield wall eliminates the conventional shield wall problem of having spacer collars knocked from shield walls by heavy equipment. When the present through-strut construction is combined with the stacked beam construction of the present invention, the resulting trench shield is very strong and durable.

BRIEF DESCRIPTION OF THE DRAWINGS

The foregoing aspects and many of the attendant advantages of this invention will become more readily appreciated in view of the following detailed description, when taken in conjunction with the accompanying drawings, wherein.

DETAILED DESCRIPTION OF THE PREFERRED EMBODIMENT

Figure 1:
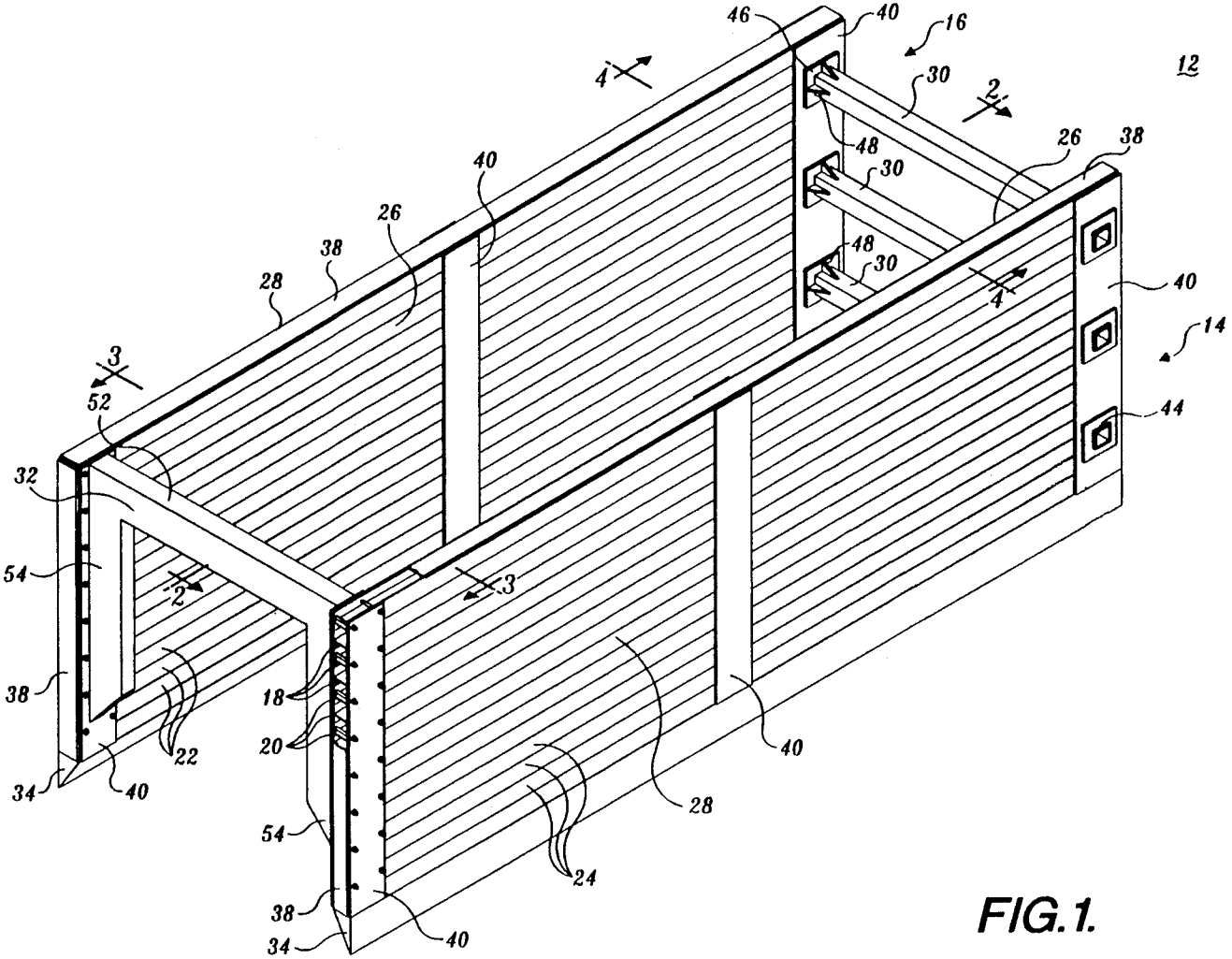
FIG. 1 is a pictorial view of a trench shield assembly constructed in accordance with the present invention.

A preferred embodiment of a trench shield 12 assembled and constructed in accordance with the present invention is shown in FIG. 1. The trench shield 12 includes a first shield wall 14 and a second shield wall 16. Each shield wall 14 and 16 is constructed from a plurality of elongate beams 18 that are stacked horizontally on top of each other and secured together. Each beam 18 includes a central web 20 and first and second face flanges 22 and 24, respectively. The beams are stacked and secured such that the first face flanges 22 define a first integral exterior skin 26 for each shield wall, and the second face flanges 24 define a second integral exterior skin 28 for each shield wall. The trench shield 12 further includes a plurality of transverse spacer struts 30 mounted between the front ends of the shield walls 14 and 16, and an archway 32 mounted between the rear ends of the shield walls, to maintain the shield walls 14 and 16 spaced apart, with the first exterior skins 26 of the shield walls opposing each other.

Pipe is laid from the rear end forward within a trench supported by the trench shield 12, with the archway 32 providing clearance into the interior of the trench shield 12. The trench shield 12 is then dragged forwardly by inserting a backhoe bucket over the spacer struts 30, and between the shield walls 14 and 16, and then pulling against the spacer struts 30.

The trench shield 12 shown in FIG. 1 includes a downwardly beveled footer 34 secured along the bottom edge of each shield wall 14 and 16 to enable the shield walls to seat better within a trench. For deeper trenches, it may be necessary to stack two or three trench shields 12 on top of each other and secure them together to form a taller composite trench shield. In such a case, only the bottom most trench shield 12 would include beveled footers 34. The high section modulus afforded by the stacked beam construction of the present invention facilitates the stacking of multiple trench shields 12.

a. Shield Wall Construction

Figure 2:
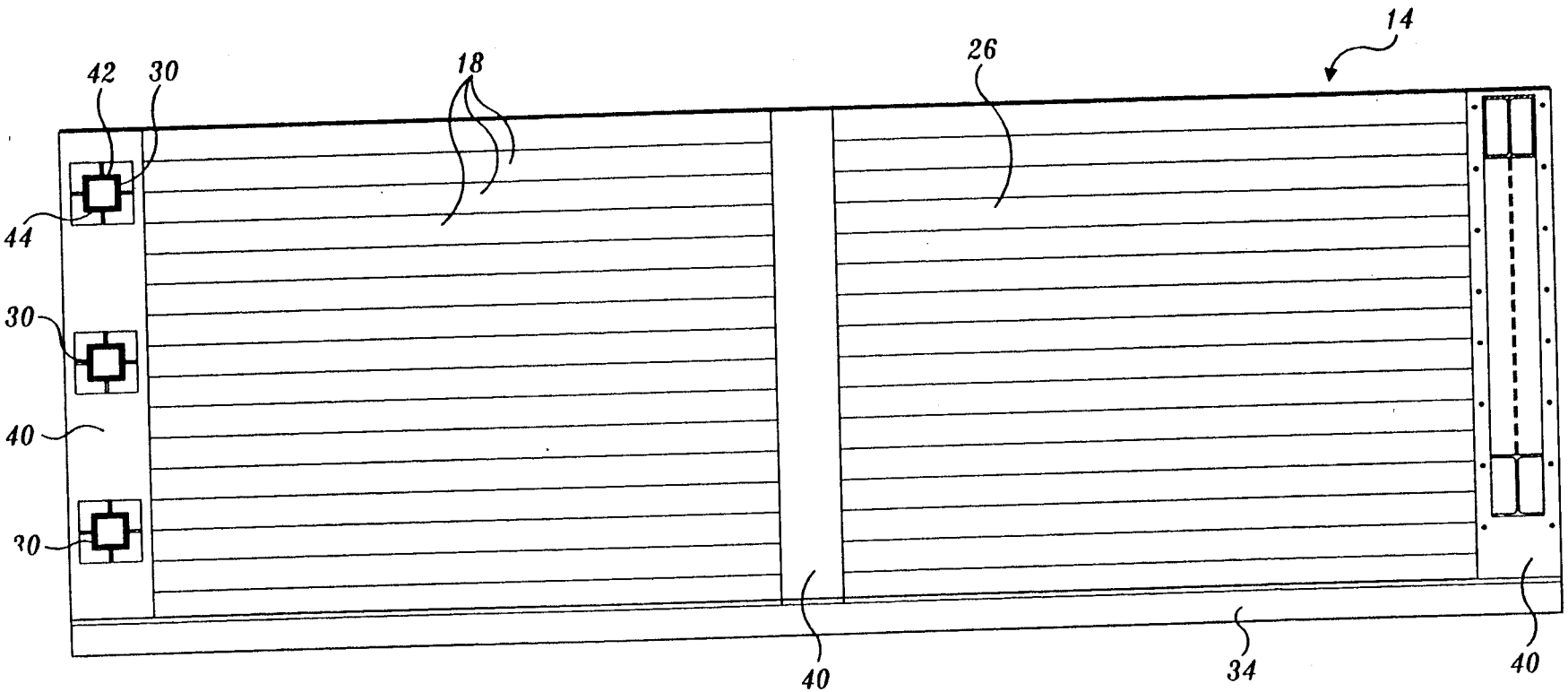
FIG. 2 is a side plan view of the first exterior skin of one of the shield walls of the trench shield of FIG. 1, with the spacer struts and the spacer archway shown in cross section, taken substantially along line 2—2 of FIG. 1.
Figure 3:
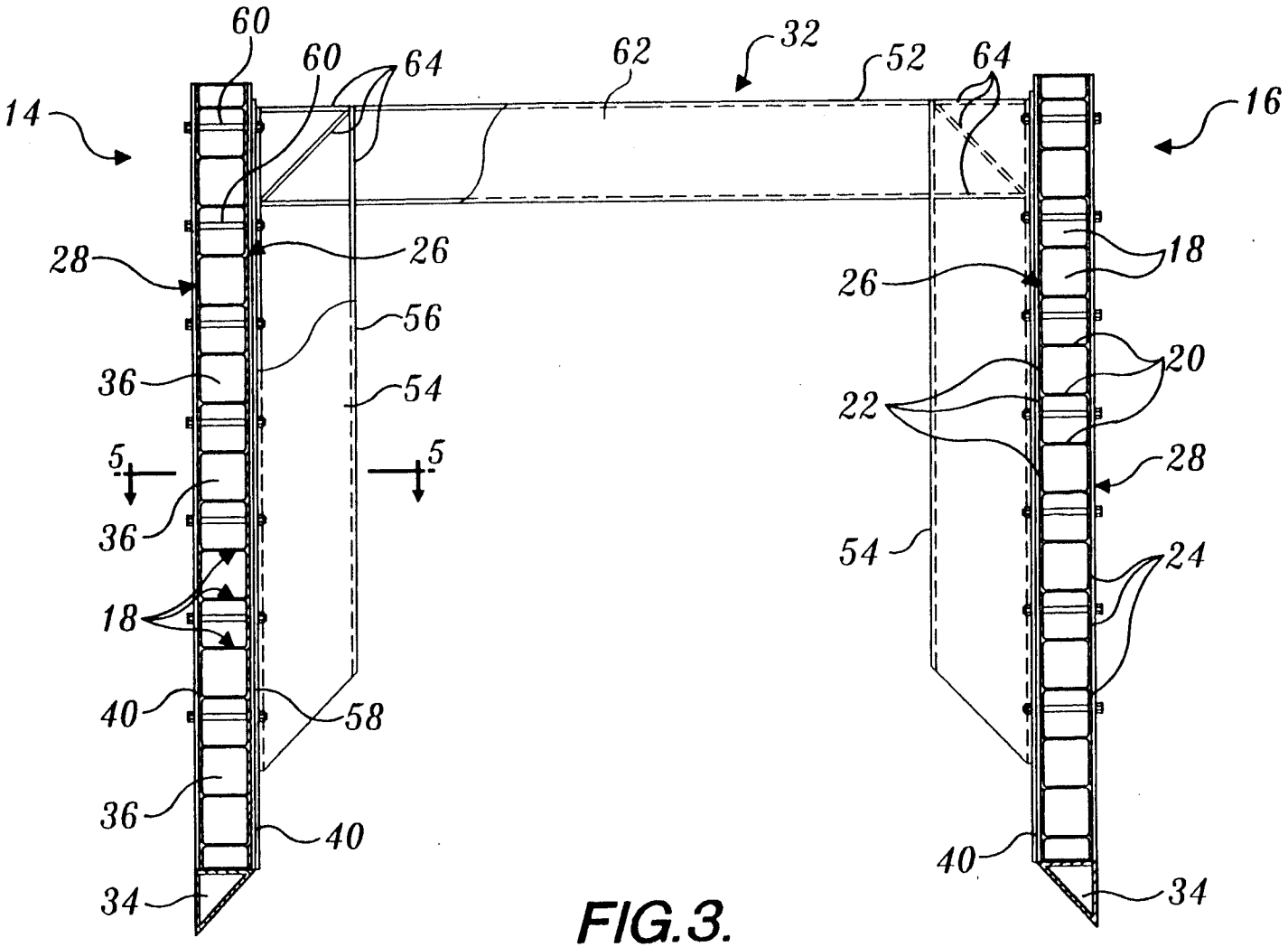
FIG. 3 is a cross-sectional view of the rear end of the trench shield assembly taken substantially along line 3—3 in FIG. 1, with a portion of the archway cover plate removed.

The construction of the shield walls 14 and 16 shall now be described in greater detail with reference to FIGS. 1, 2 and 3. The shield walls 14 and 16 are constructed identically to each other. Depending on the exact dimensions desired for the shield walls 14 and 16, the beams 18 utilized to construct the shield walls 14 and 16 may be standard metal I-section beams, H-section beams, or wide flange section beams. Standard rolled wide flange section beams have been found particularly well suited for use. Referring to FIGS. 1 and 3, the central web 20 of each beam 18 has first and second long edges. The first and second face flanges 22 and 24 are formed centrally along the long edges of the central web 20. The flanges 22 and 24 are disposed parallel to each other and perpendicular to the central web 20.

For each shield wall the beams 18 are stacked one atop another, with the long edges of the first flanges 22 of adjacent beams 18 within the stack abutting each other. Thus the first flanges 22 of the beams 18 of each shield wall are substantially coplanar, and define the first exterior skin 26. The abutting edges of each adjacent pair of first flanges 22 are fixedly and rigidly secured together, preferably by welding at periodic spaces along the length of the shield walls 14 and 16.

Likewise, the second flanges 24 of the beams 18 of each shield wall 14 and 16 are substantially coplanar, and define the second exterior skin 28. Again, the abutting long edges of adjacent second flanges 24 are welded together to secure the beams in position. Integral, rigid, exterior skins 26 and 28 are thus defined by the joined face flanges 22 and 24, respectively, of the beams 18. The central web 20 of each beam 18 spans between the first and second exterior skins 26 and 28. Thus there is no need for a separate skin secured over an internal framework, as in conventional shield walls. Instead, the stacked beams effectively define an integral framework and skins, with a much stronger shield wall resulting. Each joined pair of adjacent beams 18 within the shield walls 14 and 16 defines a separate elongate inner channel 36, as best seen in FIG. 3. Thus if either exterior skin 26 or 28 is punctured, only the individual punctured channels 36 will fill with soil or water.

To seal the channels 36 and further strengthen the shield walls 14 and 16, cap plates 38 are welded over the perimeter edges of the shield walls, as shown in FIG. 1. Additional strength and stiffness is imparted by vertical reinforcing plates 40 that are welded or otherwise secured to the outside of the exterior skins 26 and 28 of each shield wall 14 and 16. As shown in FIGS. 1 and 2, preferably three vertical reinforcing plates 40 are secured on each exterior skin 26 and 28. The three vertical reinforcing plates 40 are secured perpendicular to the longitudinal axis of the beams 18, across each end and midway along the length of the shield walls 14 and 16.

Although FIGS. 1 through 4 show shield walls 14 and 16 each constructed from sixteen stacked beams 18, a greater or lesser number of beams can be used depending on the desired height of the wall and the flange dimensions of the beams used.

Trench shield walls 12 and 14 constructed in accordance with the present invention have been found to have higher strength and dimensional stability than conventional hollow shield walls. For example, one suitable type and size of beams 18 for use with the present invention are nominal W6×20M (6 inch nominal width by 20 pounds nominal weight per lineal foot)

rolled wide flange section beams. A nominal W6×20M beam actually has a width of 6.375 inches, measured from the outside of the first face flange 22 to the outside of the second face flange 24, and a weight of 19 lbs/ft.

This computes to a section modulus of about 14.6 $inch^3$. A 10 foot high by 24 foot long shield wall constructed in accordance with the present invention using nominal W6×20M beams has a weight of about 4,560 lbs. Due to the high section modulus of about 14.6 $inch^3$, such a shield wall can be safely used to support soil loads of 740 $pounds/ft^2$, corresponding to a depth of 12 feet in type "e" soil. In contrast, conventional hollow shield walls often have a section modulus of only 7 to 8 $inch^3$.

As a further example, a W6×24.2M rolled wide flange section beam can be used to construct shield walls in accordance with the present invention, resulting in a section modulus of 17.5 $inch^3$ and a weight of 24.2 lbs/ft. Various other sizes and sections of beams can also be used, with the foregoing examples being provided for exemplary purposes only.

b. Spacer Strut Construction

The through-wall construction and mounting of the spacer struts 30 shall now be described with reference to FIGS. 1, 2, 4 and 6. The front ends of the shield walls 14 and 16 are maintained spaced apart and substantially parallel by at least one, and preferably three, transverse spacer struts 30. Referring to FIG. 2, the spacer struts are preferably constructed from square-section hollow tubing, although round-section tubing or other configurations may also be used. For added strength, the struts 30 are preferably wrapped with an outer metal cladding 42.

Figure 6:
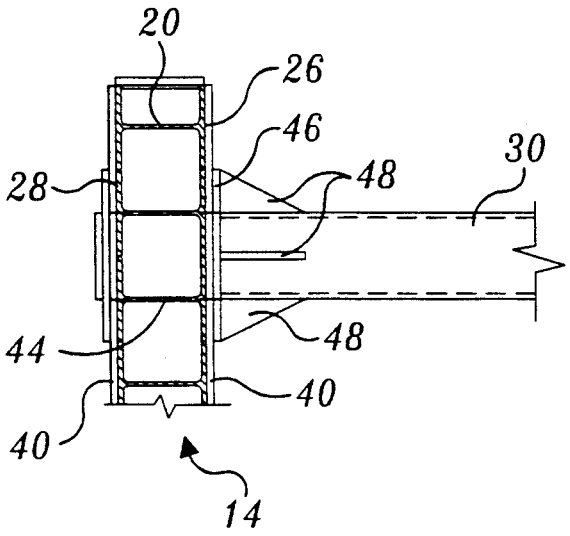
FIG. 6 is a detailed front plan view of one end of a transverse strut assembled in a shield wall as in FIG. 4.

Referring to FIGS. 1 and 6, each shield wall 14 and 16 includes three vertically spaced transverse strut passages 44 formed adjacent the front edge. The passages 44 are formed transversely thru the stacked beams 18 and inner and outer vertical reinforcing plates 40, thus extending from the first exterior skin 26 to the second exterior skin 28. Opposing aligned passages 44 in the first and second shield walls 14 and 16 receive the first and second ends of a corresponding spacer strut 30.

Figure 4:
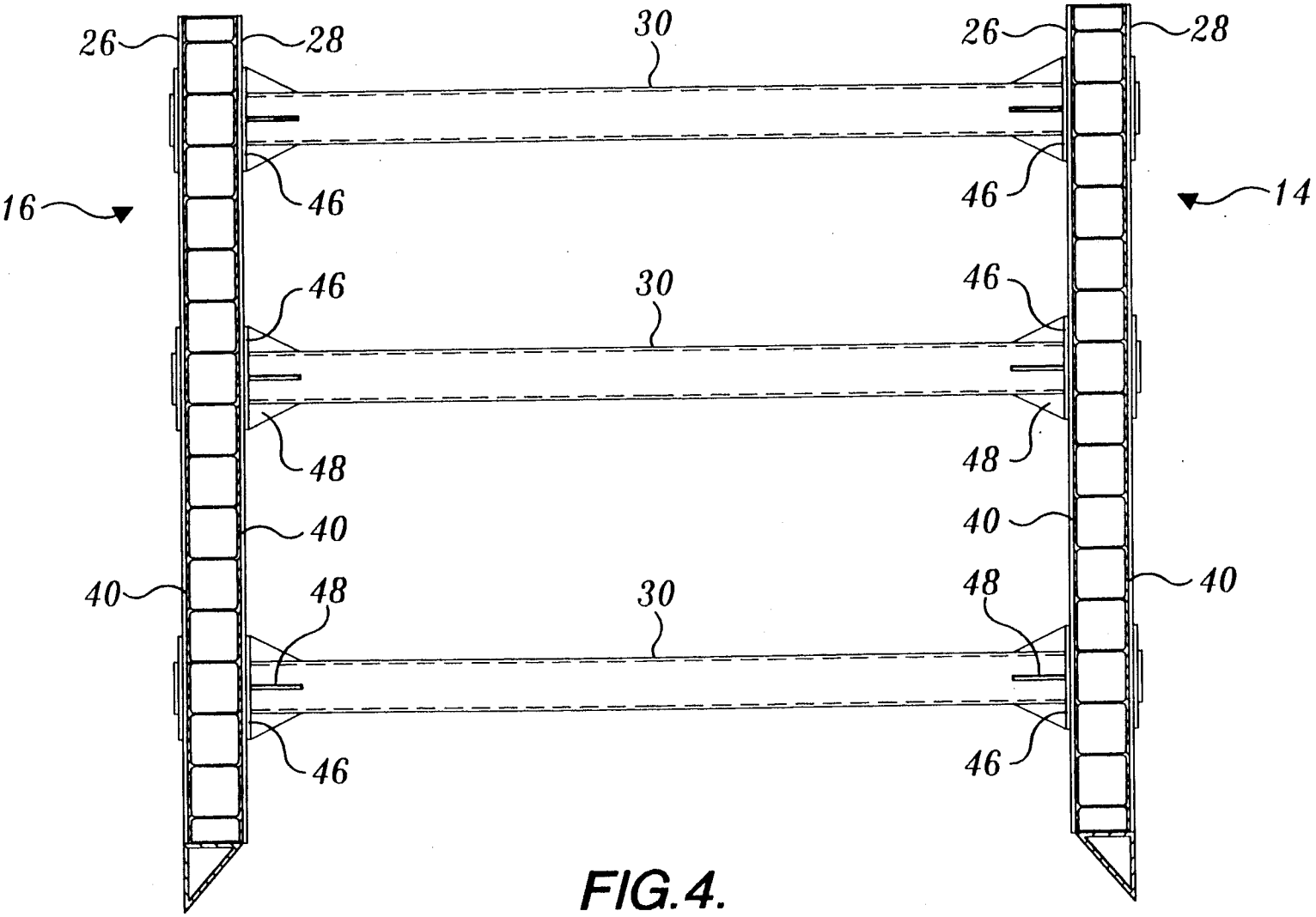
FIG. 4 is a cross-sectional view of the front end of a trench shield assembly taken substantially along line 4—4 of FIG. 1.

Referring to FIGS. 1, 4 and 6, a stop plate 46 including a central aperture therein is received over each end of the strut 30. Each stop plate 46 is welded or otherwise secured to the strut 30 at a point spaced from the end a distance determined to limit the extent of insertion of the strut 30 end into the corresponding passage 44. Each stop plate 46 is reinforced by a plurality of triangular flanges 48 extending from the inner side of the stop plate to the strut 30, on the side of the stop plate 46 opposite of the corresponding shield wall. The ends of the struts 30 are inserted through the first exterior skin 26 sufficiently to at least approach the second exterior skin 28, and more preferably to project beyond the second exterior skin 28. This through-wall construction permits lateral forces imposed on the struts 30, such as during dragging the trench shield 12, to be transferred through the passages 44 to the interior of the shield walls 14 and 16. Thus the struts do not tend to break free from the shield walls, as in conventional shield walls.

Figure 7:
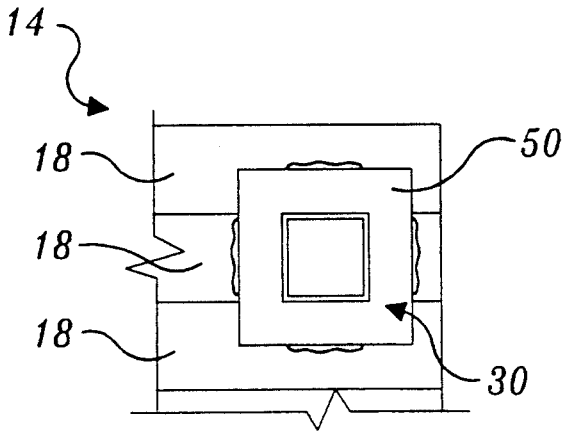
FIG. 7 is a partial side plan view of the projecting end of one of the installed spacer struts of FIG. 1, with the remainder of the shield wall broken away.

Referring to FIGS. 6 and 7, the ends of each strut 30 are retained inserted thru the corresponding passages 44 by locking plates 50. The locking plates 50 each have an aperture formed centrally therein, which is inserted over the projecting end of the strut 30. The locking plate 50 is welded or otherwise secured to the end of the strut 30 to prevent the strut from withdrawing from the passage 44.

c. Archway Construction

One or more transverse struts can also be used to separate the rear ends of the shield walls 14 and 16. However, it has been found preferable to use the archway 32 to separate the rear ends, as shown in FIG. 1. The archway 32 is preferably constructed from covered wide flange section beams to enhance the archway's strength and stiffness. Referring to FIGS. 1 and 3, the archway 32 includes a transverse central span section 52 and two downwardly extending side sections 54.

Figure 5:
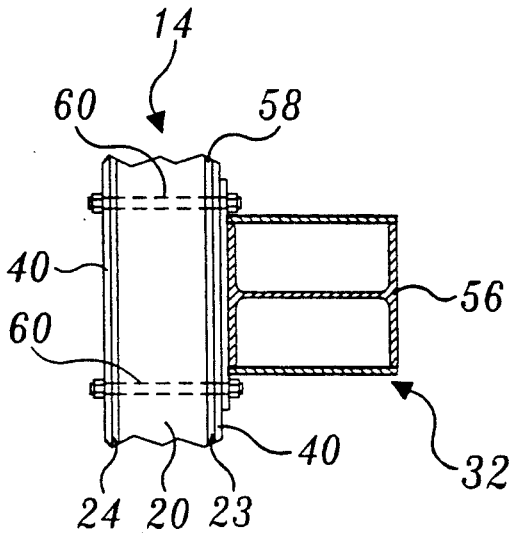
FIG. 5 is a cross-sectional view of the spacer archway as taken along line 5—5 in FIG. 3.

Referring to FIGS. 3 and 5, each side section 54 of the archway 32 is constructed from a beam 56 that is similar to the beams 18 used to construct the shield walls 14 and 16, except for differing dimensions. Each beam 56 extends downwardly from the upper edge of the corresponding shield wall 14 or 16. One face flange of the beam 56 is welded or otherwise secured to a mounting plate 58. The mounting plate 58 is secured adjacent the inner vertical reinforcing plate 40 of the corresponding shield wall 14 or 16 by a plurality of bolts 60 or other fasteners that pass thru aligned bores formed in the mounting plates 40 and the shield wall.

Referring to FIG. 3, the central span section 52 is also formed from a beam, such as a wide flange section beam 62. The central beam 62 is welded or otherwise secured between the side beams 56, with the face flanges of the central beam 62 being horizontally disposed. Additional horizontal reinforcing members 64 are welded within and across the upper ends of the side beams 54, to reinforce the archway 32. Referring to FIGS. 3 and 5, the beams 56 and 62 forming the archway 32 are covered by reinforcing plates 66, which are welded across the edges of the face flanges of each beam. The resulting archway is highly stable.

d. Alternate Preferred Embodiments

Figure 8:
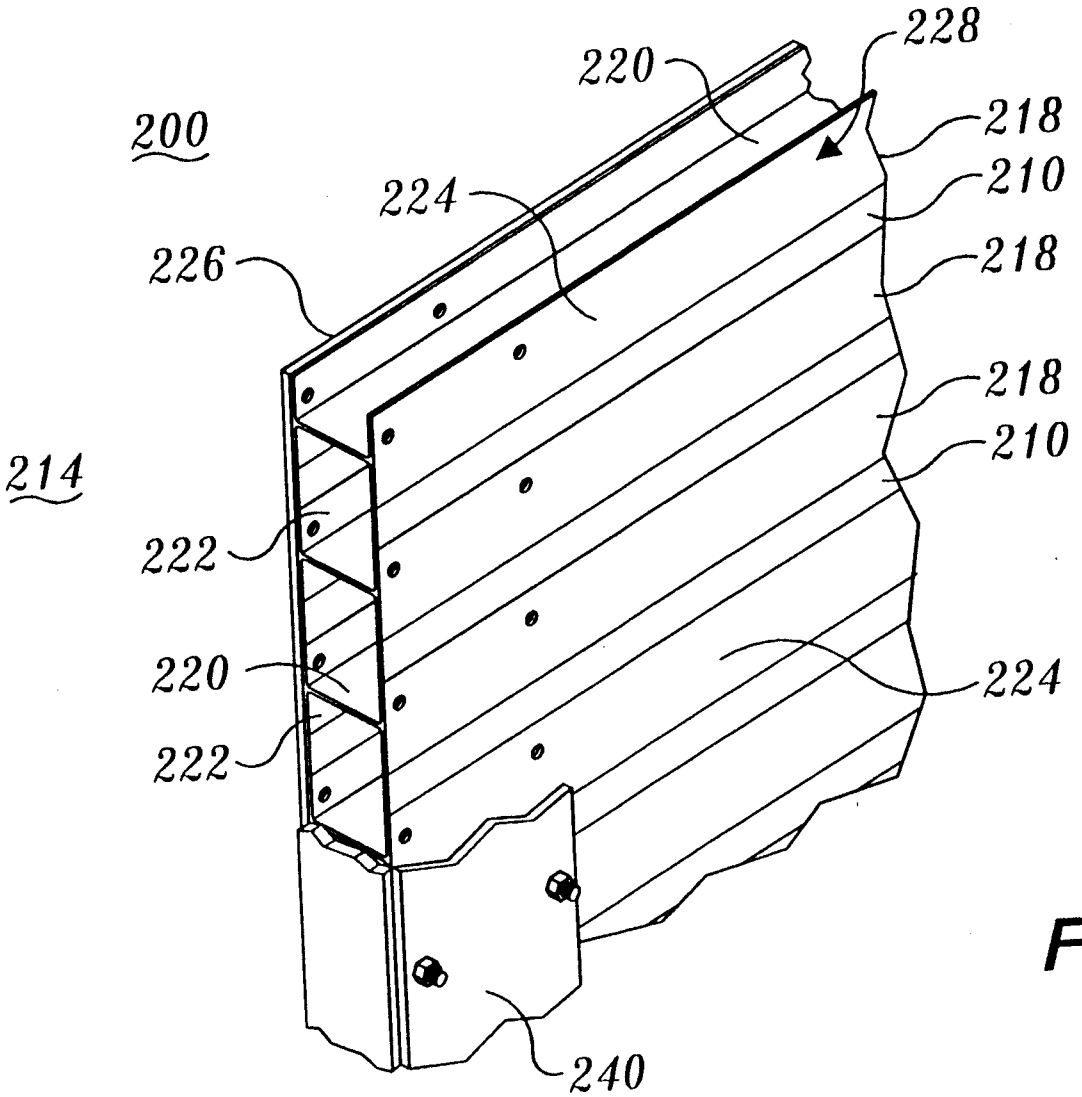
FIG. 8 is a partial pictorial view of an alternate embodiment of a shield wall constructed with extension plates secured between adjacent stacked beams.

Although a preferred embodiment of a trench shield 12 has been described above, one of ordinary skill in the art will recognize from the disclosure contained herein that various changes to the trench shield 12 can be made in accordance with the present invention. For example, an alternate embodiment of a trench shield wall 200 constructed in accordance with the present invention is shown in FIG. 8. The shield wall 200 is identical to shield walls 14 and 16, with one exception. Elongate extension plates 210 are welded or otherwise secured edgewise between each adjacent pair of stacked beams 218.

The beams 218 are spaced vertically apart from each other, with the extension plates 210 filling the spaces there between. Thus the long edges of a first face flange 222 of a lower beam 218 and a first face flange 222 of an overlying upper beam 218 are secured to the long edges of a coplanar extension plate 210 to define a first exterior skin 226. Similarly, coplanar second face flanges 224 and coplanar extension plates 210 secured there between form a second exterior skin 228. The extension plates 210 thus effectively increase the width of the flanges 222 and 224 of the beams 218. The result of this alternate, and perhaps preferred construction, is an increased height for the shield wall 200 without a significant decrease in the section modulus, and with a less than proportional increase in weight.

Figure 9:
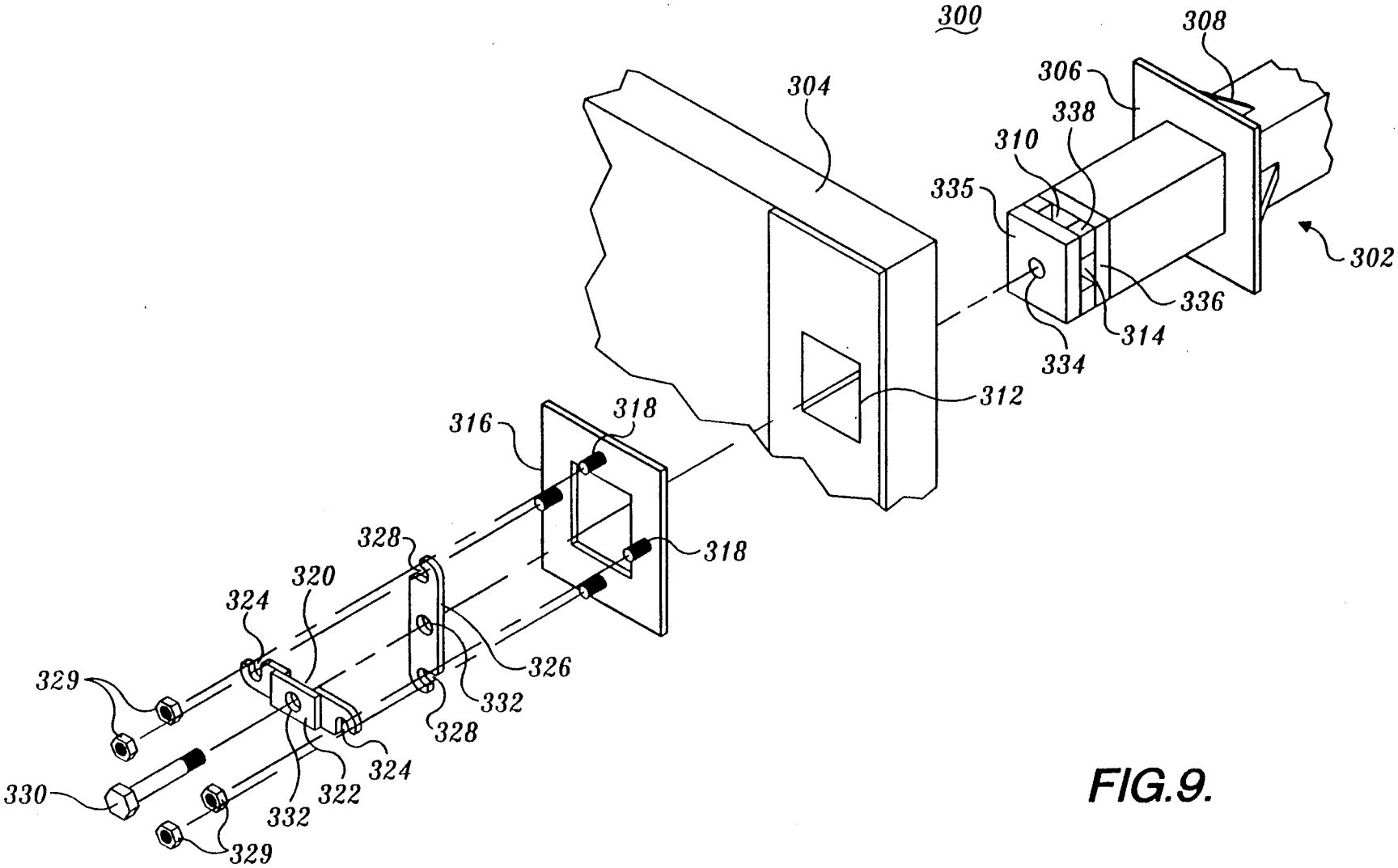
FIG. 9 is an exploded front plan view of an alternate selectively securable spacer strut.
Figure 11:
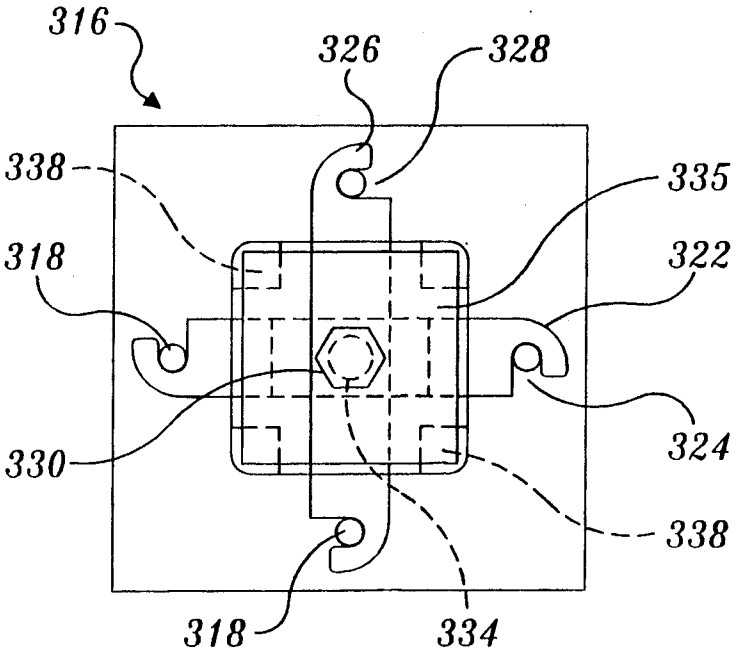
FIG. 11 is a side plan view of the projecting end of the assembled selectively securable spacer strut of FIG. 10.
Figure 10:
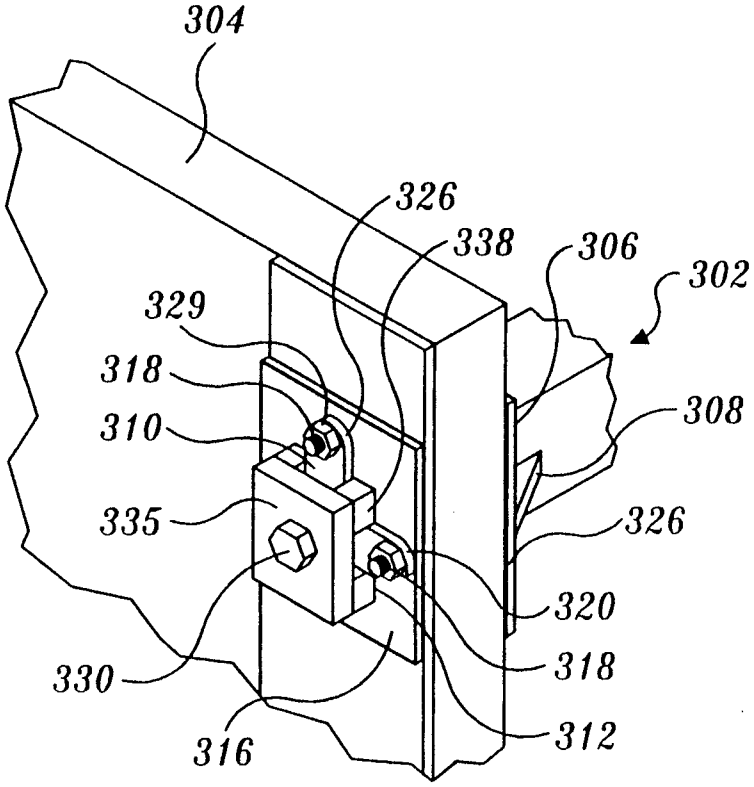
FIG. 10 is a front plan view of the alternate selectively securable spacer strut of FIG. 9 after assembly.

Another example of an alternate embodiment is illustrated in FIGS. 9 through 11, which show a portion of a trench shield assembly 300 that is easily disassembled. The trench shield 300 is identical to the previously described trench shield 12, except that the trench shield 300 includes transverse struts 302 that are selectively engageable and disengageable from the shield walls 304. As shown in FIGS. 9 and 10, a stop plate 306 and supporting flanges 308 are secured on each end of the strut 302 at a point spaced from the end of the strut, as in the previously described embodiment. However, a first lateral passage 310 is formed crosswise through the end portion of the strut 302. When the trench shield is assembled, the end portion of the strut 302 including the first lateral passage 310 projects through a transverse strut passage 312 formed in the shield wall 304 when the trench shield is assembled. A second lateral passage 314 is formed crosswise thru this projecting end portion of the strut 302, perpendicular to and axially aligned with the first lateral passage 310.

After the strut 302 is inserted thru the passage 312 in the shield wall 304, a retaining plate 316 having a central aperture formed therein is inserted over the projecting end of the strut 302. Four threaded studs 318 project outwardly from the outer surface of the plate 316, with one stud 318 positioned centrally on each side of the retaining plate 316. A first elongate locking bar 320 is then inserted through the second lateral passage 314 in the end of the strut 302. A pair of notches 324 are formed in opposing side edges of the locking bar 320, near either end of the locking bar 320. The locking bar 320 can be rotated slightly in the counter clockwise direction, as viewed in FIG. 11, to engage the notches 324 over two studs 318 on the retaining plate 316.

Referring to FIG. 9, the first locking bar 320 also includes a central dog leg portion 322 that accommodates the insertion of a second locking bar 326 through the first lateral passage 310 in the end of the strut 302. The second locking bar 326 also includes two notches 328 that engage with the remaining two studs 318 on the retaining plate 316. Referring to FIGS. 9 through 11, nuts 329 are then threaded onto the studs 318 to secure the locking bars 320 and 326 engaged on the studs 318.

A retaining fastener 330 is also preferably axially inserted thru aligned apertures 332 formed in the locking bars 320 and 326, to further secure the locking bars within place. The fastener 330 is then threaded thru a bore 334 formed axially thru an end cap 335 welded over the outermost end of the strut 302, and a filler plate 336 welded across the end of the strut 302, inwardly of the end cap 336. In the embodiment illustrated in FIG. 9, the end of the strut 302 is built up with the filler plate 336, intermediate spacer blocks 338, and the end cap 335 to define the lateral passages 310 and 314. However, it should be apparent that the passages 310 and 314 could instead be machined through the tubular walls of the strut 302.

The assembled locking bars 320 and 326 prevent the strut 302 from withdrawing from the shield wall 304. However, the trench shield can be conveniently disassembled for transport by undoing nuts 329 and fastener 330, enabling withdrawal of the locking bars 320 and 326 and then disengagement of the strut 302 from the transverse passage 312 in the shield wall 304.

While the preferred embodiment of the invention and several variations thereof have been illustrated and described, it will be appreciated that various changes, alterations and substitutions of equivalents can be made therein without departing from the spirit and scope of the invention. Accordingly, it is intended that the scope of letters patent granted hereon be limited only by the appended claims and equivalents thereto.

The embodiments of the invention in which an exclusive property or privilege is claimed are defined as follows:

1. A trench shield assembly, comprising:

first and second shield walls each constructed from a plurality of horizontally disposed elongate members stacked adjacent and on top of each other in a continuous stack extending from the bottom to the top of the shield wall, each elongate member defining a longitudinal axis extending lengthwise of the beam, wherein at least some of the elongate members comprise beams, each beam including a central web and first and second parallel face flanges, the first face flanges of the stacked beams defining a first integral exterior skin of the shield wall and the second face flanges of the stacked beams defining a second integral exterior skin of the shield wall, with the central webs of the beams spanning between the first and second exterior skins, wherein each elongate member defines an elongate interior surface that extends the length of the member and that is oriented parallel to the longitudinal axis of the member, whereby the elongate interior surface defines at least a portion of an elongate inner channel extending the length of the member;

means for immovably and rigidly securing together elongate edges of adjacent stacked elongate members; and means mounted between the first and second shield walls for maintaining the first and second shield walls spaced apart, with the first exterior skins of the first and second shield walls opposing each other.

2. The trench shield assembly of claim 1, wherein for each of the first and second shield walls:

all of the elongate members comprise beams that are stacked in a continuous stack; and the means for immovably and rigidly securing the elongate members consists essentially of welds formed between the edges of the first and second face flanges of each beam and the edges of the first and second face flanges, respectively, of the adjacent stacked beams.

3. The trench shield assembly of claim 1, wherein:

at least some of the elongate members are elongate extension plates interspersed in the stack between the beams;

the means for immovably and rigidly securing the elongate members consists essentially of a plurality of welds; and one extension plate being disposed and welded edgewise between the first face flange of each lower beam and the first face flange of an overlying upper beam, and another extension plate being disposed and welded edgewise between the second face flange of each lower beam and the second face flange of the upper beam.

4. The trench shield assembly of claim 1, wherein each of the first and second shield walls are constructed from wide flange section beams.

5. The trench shield assembly of claim 1, wherein:

each of the first and second shield walls includes a transverse passage extending thru the shield wall from the first exterior skin to the second exterior skin; and the means for maintaining the shield walls includes:

an elongate transverse strut having first and second ends constructed to be insertable thru the transverse passages of the first and second shield walls, to at least approach the second exterior skins of the shield walls;

first and second means securable to the strut at a location spaced from the first and second ends, respectively, for limiting the degree of insertion of the strut through the first and second passages; and engaging means for engaging each of the first and second ends of the inserted strut to prevent withdrawal of the strut from the passages of the first and second shield walls.

6. The trench shield assembly of claim 5, wherein the engaging means is selectively disengageable from the strut to enable withdrawal of the strut from the first and second shield walls.

7. The trench shield of claim 1, further comprising at least one vertical reinforcing plate secured to at least one of the exterior skins of each shield wall.

8. A trench shield wall comprising:

a plurality of horizontally disposed elongate members stacked adjacent and on top of each other in a continuous stack extending from the bottom to the top of the shield wall, each elongate member defining a longitudinal axis extending lengthwise of the beam, wherein at least some of the elongate members comprise beams, each beam including a central web and first and second parallel face flanges, and each elongate member defines an elongate interior surface that extends the length of the member and that is oriented parallel to the longitudinal axis of the member, whereby the elongate interior surface defines at least a portion of an elongate inner channel extending the length of the member; and means for immovably and rigidly securing together elongate edges of adjacent stacked elongate members such that the first face flanges of the stacked beams define a first integral exterior skin of the shield wall and the second face flanges of the stacked beams define a second integral exterior skin of the shield wall, with the central webs of the beams spanning between the first and second exterior skins.

9. The trench shield wall of claim 8, wherein:

all of the elongate members comprise beams that are stacked in a continuous stack; and the means for immovably and rigidly securing the members consists essentially of welds formed between the edges of the first and second face flanges of each beam and the edges of the first and second face flanges, respectively, of the adjacent stacked beams.

10. The trench shield wall of claim 8, wherein:

at least some of the elongate members are elongate extension plates interspersed in the stack between the beams;

the means for immovably and rigidly securing the elongate members consists essentially of a plurality of welds; and one extension plate being disposed and welded edgewise between the first face flange of each lower beam and the first face flange of an overlying upper beam, and another extension plate being disposed and welded edgewise between the second face flange of each lower beam and the second face flange of the upper beam.

11. The trench shield assembly of claim 10, wherein each of the first and second shield walls are constructed from wide flange section beams.

12. The trench shield wall of claim 8, further comprising at least one vertical reinforcing plate secured to at least one of the exterior skins of the shield wall.

13. A trench shield wall comprising:

a plurality of elongate members disposed parallel to each other and stacked adjacent each other in a continuous stack extending from a first long side of the shield wall to a second long side of the shield wall, each elongate member defining a longitudinal axis extending lengthwise of the beam, wherein at least some of the elongate members comprise beams, each beam including a central web and first and second parallel face flanges, and each elongate member defines an elongate interior surface that extends the length of the member and that is oriented parallel to the longitudinal axis of the member, whereby the elongate interior surface defines at least a portion of an elongate inner channel extending the length of the member; and means for immovably and rigidly securing together elongate edges of adjacent stacked elongate members such that the first face flanges of the stacked beams define a first integral exterior skin of the shield wall and the second face flanges of the stacked beams define a second integral exterior skin of the shield wall, with the central webs of the beams spanning between the first and second exterior skins.

14. A trench shield assembly, comprising:

first and second shield walls, each shield wall including at least one transverse passage extending thru the shield wall from a first exterior skin to a second exterior skin; and means mounted between the first and second shield walls for maintaining the first and second shield walls spaced apart, with the first exterior skins of the first and second shield walls opposing each other, the means for maintaining the shield walls including:

an elongate transverse strut having first and second ends constructed to be insertable thru the transverse passages of the first and second shield walls, to at least approach the second exterior skins of the shield walls;

first and second means securable to the strut at a location spaced from the first and second ends, respectively, for limiting the degree of insertion of the strut through the first and second passages; and engaging means for engaging each of the first and second ends of the inserted strut to prevent withdrawal of the strut from the passages of the first and second shield walls.

15. The trench shield assembly of claim 14, wherein the engaging means is selectively engageable and disengageable from the strut to enable disassembly of the strut from the first and second shield walls.

* * * * *